US007114634B2

(12) United States Patent
Azodi

(10) Patent No.: US 7,114,634 B2
(45) Date of Patent: Oct. 3, 2006

(54) FIZZ RETAINING DEVICE FOR BEVERAGE CONTAINERS

(76) Inventor: Ghasem Azodi, 206 Jaimes Ct., Houston, TX (US) 77094

( * ) Notice: Subject to any disclaimer, the term of this patent is extended or adjusted under 35 U.S.C. 154(b) by 363 days.

(21) Appl. No.: 10/772,496

(22) Filed: Feb. 5, 2004

(65) Prior Publication Data

US 2005/0173453 A1 Aug. 11, 2005

(51) Int. Cl.
*B67D 5/00* (2006.01)

(52) U.S. Cl. ..... 222/81; 222/5; 222/83; 222/91; 222/400.7; 222/509; 137/318

(58) Field of Classification Search ..... 222/80–81, 222/5, 86–89, 90–91, 529, 394, 520, 396–397, 222/509, 400.7, 82–83, 83.5; 137/318, 322; 251/347–349; 215/228, 355; 220/212
See application file for complete search history.

(56) References Cited

U.S. PATENT DOCUMENTS 3,092,291 A * 6/1963 Franck ..... 222/83
3,817,302 A * 6/1974 Kowal et al. ..... 141/383
4,281,775 A * 8/1981 Turner ..... 222/82
4,375,864 A * 3/1983 Savage ..... 222/81
4,723,670 A * 2/1988 Robinson et al. ..... 215/228
5,095,962 A * 3/1992 Lloyd-Davies et al. ..... 141/346
5,335,821 A * 8/1994 Osgar ..... 222/83
6,883,682 B1 * 4/2005 Anderson ..... 222/83

* cited by examiner

*Primary Examiner*—Frederick C. Nicolas

(57) ABSTRACT

A carbonation retaining closure assembly device for beverage containers. The device comprising a cap member manufactured to seal and adapted to engage with the mouth of the beverage container. An inner groove surrounds the outer peripheral edge of the cap member forming a stud within the center of the cap member. The stud has a threaded outer wall. A connector member has an internal bore dimensioned to accommodate the length and circumference of the stud. The bore has means for securely engaging upon the outer wall of the stud. A cutting means is internally mounted within the top layer of the bore wherein a slit is punctured within the outer wall as the connector member is engaged upon the stud. A dispensing mechanism is disposed upon the top of the connector member for dispensing the beverage through the slit such that the carbonation level in the beverage container is retained.

16 Claims, 6 Drawing Sheets

FIZZ RETAINING DEVICE FOR BEVERAGE CONTAINERS

BACKGROUND

The present invention relates to closure devices for carbonated beverage containers. The retention of the carbonation of a beverage after the container is initially open has been a problem recognized in the prior art. After the container is initially unsealed, the carbonated beverage immediately begins to loose its carbonation. Over time the beverage becomes flat even though the cap is utilized to reseal to the container. The carbonation continues to escape from the liquid into the interior of the container above the liquid.

A patent search was done and the following U.S. patent No.'s were found: U.S. Pat. No. 4,723,670 to Robinson et al which provides a hand-operated pump combined with a closure cap for sealing and pressuring the open space within a carbonated beverage container, U.S. Pat. No. 5,031,785 to Lemme which provides a combination pressure and vacuum pump for food or drink, and U.S. Pat. No. 4,899,896 to Metzger which provides a cap adapted for use in pressurizing the interior of a container for carbonated beverages.

The above mentioned patents disclose a device to repressurize the container to retain the carbonation within the beverage container once the container is opened. Additionally, the patents found from the search performed did not disclose a structure similar to the applicant's structure to be described herein.

SUMMARY

The object of the present invention is to provide an improved device for retaining carbonation inside beverage containers after opened for use. The present invention provides an assembly for a closure device for carbonated beverages. The device comprising a cap member manufactured to seal and adapted to engage with the mouth of the beverage container. An inner groove surrounds the outer peripheral edge of the cap member forming a stud within the center of the cap member. The stud has a threaded outer wall. A connector member has an internal bore dimensioned to accommodate the length and circumference of the stud. The bore has means for securely engaging upon the outer wall of the stud. A cutting means is internally mounted within the top layer of the bore wherein a slit is punctured within the outer wall as the connector member is engaged upon the stud.

The device further includes a dispensing mechanism in the form of a pouring spout situated upon the connector member. A lever with an attached handle can be removably connected to the pouring spout to assist the user in the dispensing process. The dispensing mechanism can be configured to dispense from a plurality of carbonated beverage containers. In addition, an alternative form of the dispensing mechanism can be incorporated into a refrigerator.

The present invention consists of the arrangement of the parts hereinafter more fully describe in the specification, illustrated in the accompanying drawings and more particularly pointed out in the appended claims. It is understood that changes maybe made in form, size proportion and minor details of construction without departing from the spirit or sacrificing any of the advantages of the invention.

BRIEF DESCRIPTION OF DRAWING(S)

DETAILED SPECIFICATION

Figure 1:
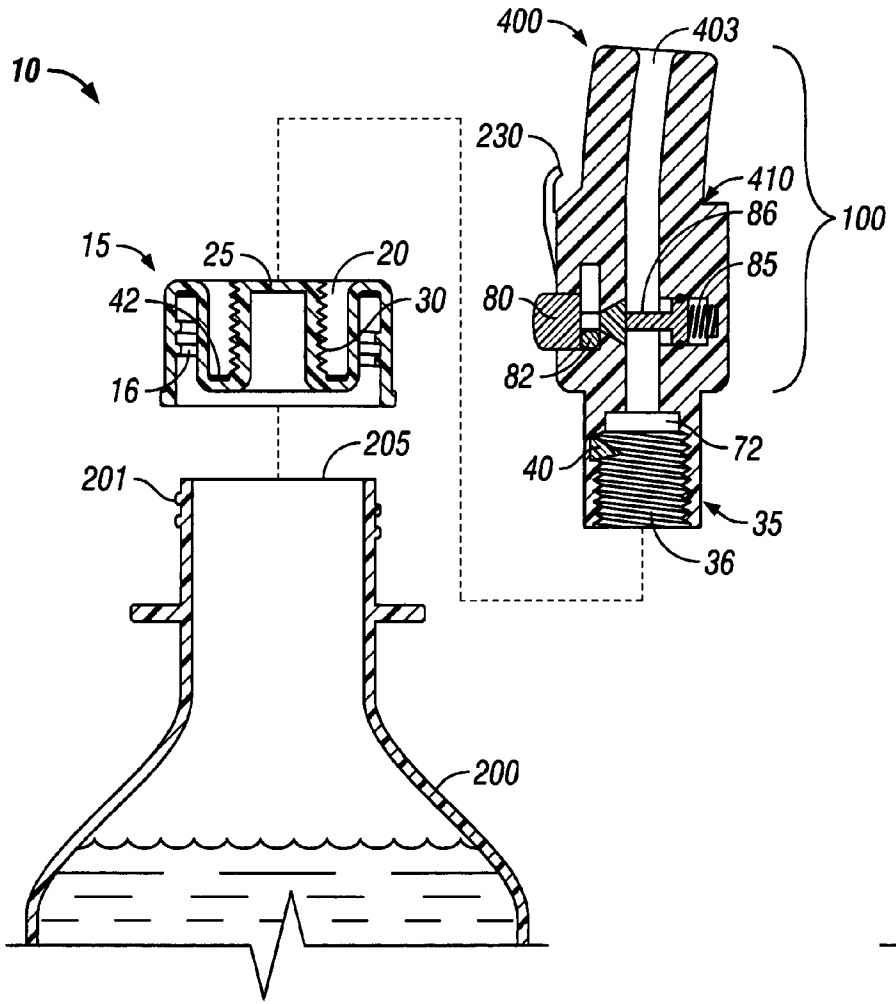
FIG. 1 is a cross-sectional side view of each part of the device disconnected from the beverage container.

Referring to FIG. 1, there is illustrated one embodiment of the different components of the present invention, a closure device (10) for a beverage container (200). The main components of device (10) include cap member (15), connector member (35), and dispensing mechanism (100). For illustration, in FIG. 1, the main components of the closure device are disconnected.

Figure 2:
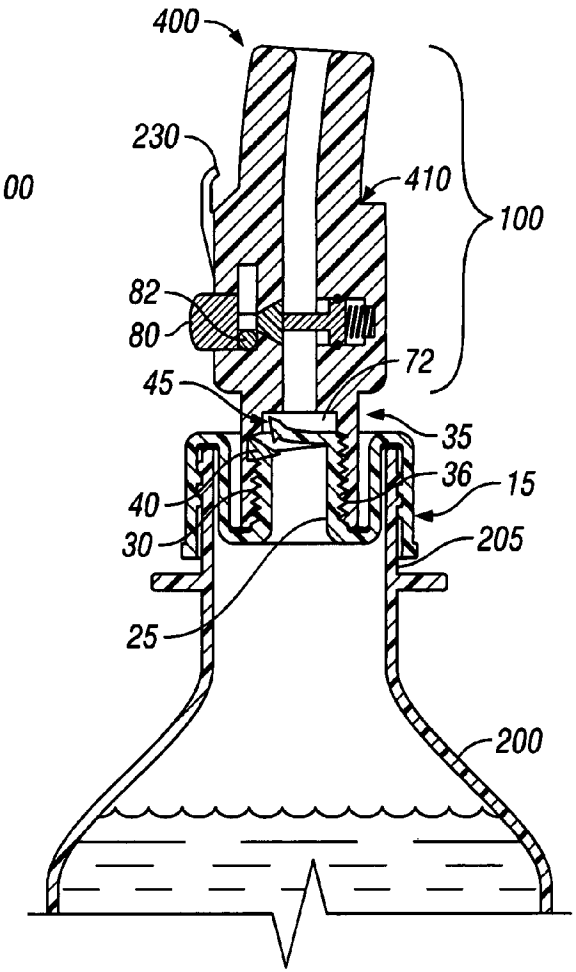
FIG. 2 is a cross-sectional side view of the device connected to the beverage container.

As shown, cap member (15) has a threaded interior wall (16) adapted to engage the mouth (201) of the beverage container (200). As shown in FIG. 2, cap member (15) has interior threading which is manufactured to engage with and seal the conventional outer threading of the mouth (201) of the container (200). After the carbonated beverage is stored within container (200), cap member (15) is manufacturally sealed upon the mouth (201) of container (200) in such a manner as to maintain the required carbon dioxide pressure level within the container (200).

As depicted in FIG. 1, an inner groove (20) surrounds the outer peripheral edge of the cap member (15) forming a stud (25) within the center of the cap member (15). Stud (25) has a threaded outer wall (30) for engagement with connector member (35). The height and length of stud (25) can vary depending upon manufacturer design requirements. The illustrated embodiment further comprises connector member (35) having an internal bore (36) dimensioned to accommodate the length and the circumference of the stud (25). Bore (36) has means for circumferentially engaging the threaded outer wall (30) of stud (25).

Cap member (15) can further include sealing means (42). As shown, sealing means (42) can be an integral washer circumferentially surrounding the bottom of stud (25).

As depicted in FIG. 1, internally disposed within the top layer of bore (35) is cutting means (40). As depicted, cutting means (40) is a small triangular shape blade permanently mounted within the upper layer of bore (36). The blade extends laterally outward from the inner wall of bore (36). The blade can made of steel or another suitable material.

As shown in FIG. 2, in use, as the connector member (35) is engaged upon stud (25), a slit (45) is punctured into the outer wall of stud (25). Internal bore (36) is securely threaded onto the outer wall (30) of stud (25). Upon the final turn of threading bore (36) upon stud (25), cutting means (40) punctures a slit (45) in the outer wall of stud (25). Slit (45) provides an opening leading into outlet port (72) formed at the upper end of connector member (35). Outlet port (72) provides the means for the dispensing of the beverage from the container (200). In this embodiment, throughout the dispensing process, cap member (15) remains sealed and is never disengaged from the mouth of container (200).

Dispensing mechanism (100) is operationally connected to the top of the connector member (35). As a portion of the beverage is removed from the container through dispensing mechanism (100), the original carbonation level in the beverage container is always retained. The major advantage of the present invention is that the length of the storage time of the remaining portion of the beverage within the container does not affect the carbonation level. With the present invention, the original carbonation level is retained until the last drop of beverage is dispensed.

Referring to FIG. 1, dispensing mechanism (100) is a pouring spout (400) integrally formed upon the upper outlet port (72) of connector member (35). Pouring spout (400) extends vertically upward from connector member (35) and includes a cylindrical shape bore (403) extending upward from outlet port (72). In the illustrated embodiment, pouring spout (400) has a stepped portion (410) with a slightly smaller diameter. A valve (85) is operationally coupled to outlet port (72). Valve (85) includes a hand controlled button mechanism (80) operationally coupled to a moveable valve element (86) for opening and closing the outlet port (72) for dispensing beverage from container (200).

Referring to FIG. 1, to prevent the operation of button mechanism (80) while container (200) is in an upright storage position, locking mechanism (82) is coupled to button mechanism (80). In this embodiment locking mechanism (82) includes a groove is formed within the pouring spout (400) lying along the backside of button mechanism (80). Locking mechanism (82) further includes a ball slidably engaged within the groove. While the container (200) is in an upright storage position, the ball remains positioned behind the button mechanism (80) preventing the depression of button mechanism (80). However, when the container (200) is placed in a pouring position, the ball travels down the groove to allow the depression of button mechanism (80). Here, locking mechanism (82) provides the advantage of preventing the escape of carbonation from the container while the container is in an upright storage position. Thus, the original carbonation pressure is never loss from the container due to accidental depression of button mechanism (80).

Figure 3:
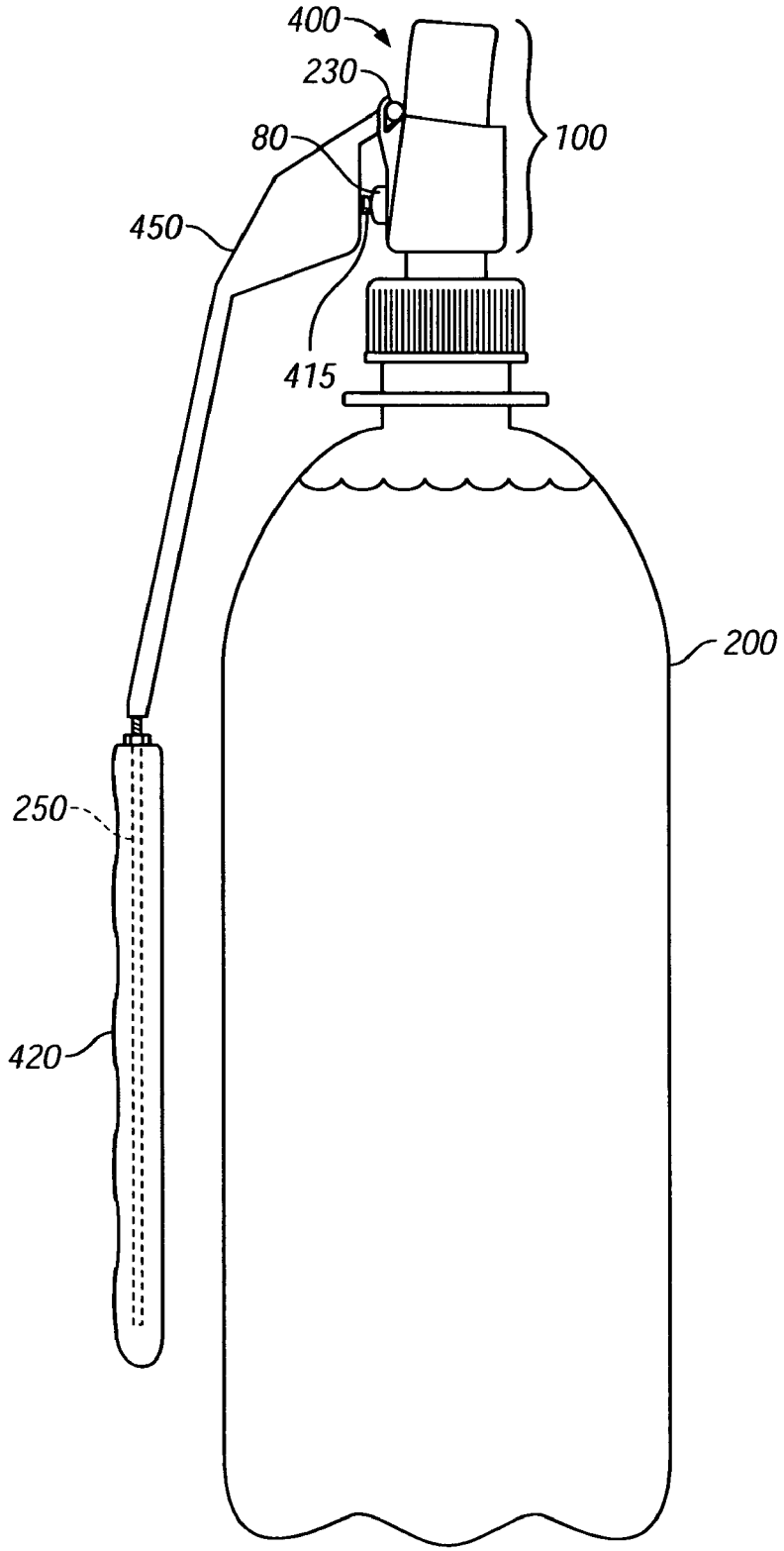
FIG. 3 is a front view of the device connected to the beverage container with the addition of a handle.

Referring to FIG. 3, dispensing mechanism (100) can further include a lever (450) to assist in dispensing the beverage from container (200). Lever (450) is externally mounted parallel to the upper most section of pouring spout (400) above button mechanism (80). Lever (450) is aligned adjacent to and parallel with the pouring spout (400).

Figure 4:
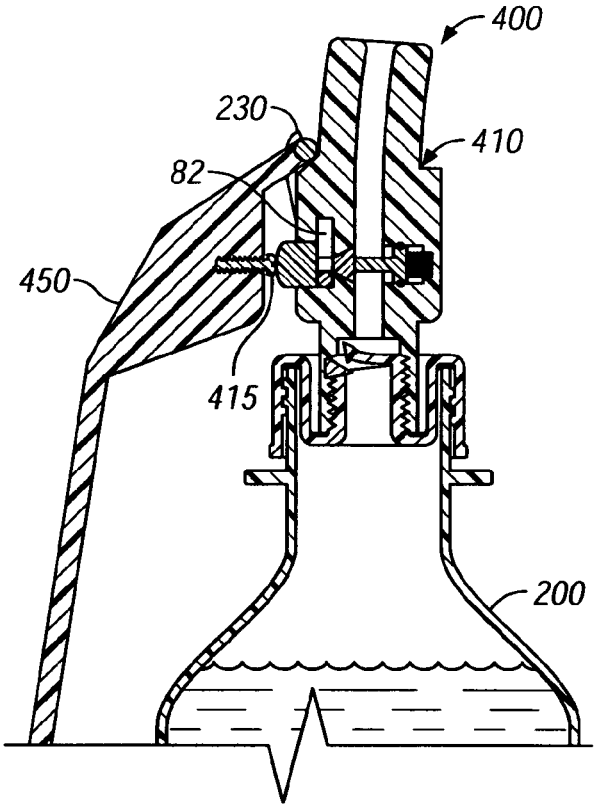
FIG. 4 is an exploded cross-sectional side view of the device connected to the beverage container in an upright position with the addition of the lever.
Figure 5:
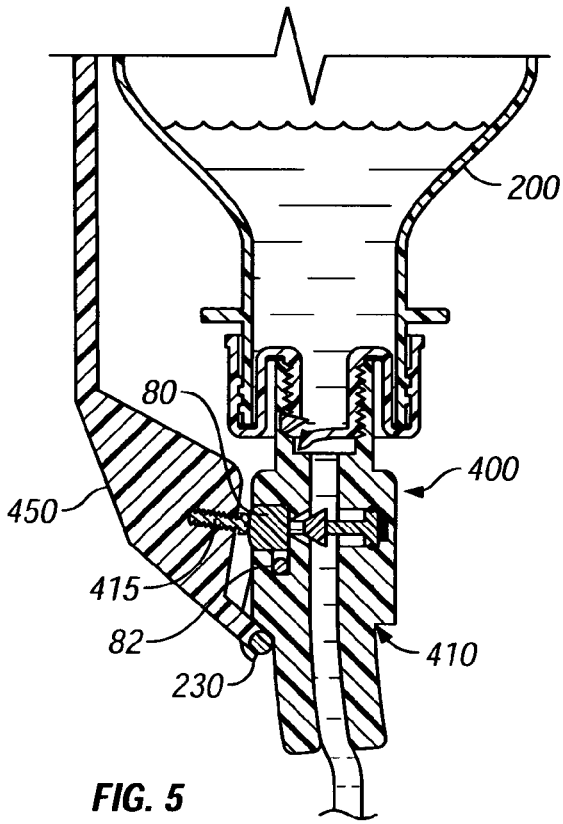
FIG. 5 is an exploded cross-sectional side view of the device connected to the beverage container in a pouring position with the addition of the lever.

Referring to FIG. 4, container (200) is shown in an upright storage position while FIG. 5 shows container (200) in a pouring position. Bolt member (415), a type of actuator, is perpendicularly connected to the uppermost section of lever (450) at a position aligned directly above the button mechanism (80). The bolt member (415) protrudes outward to a desired height which is adjustable by the user. As illustrated, bolt member (415) can be adjustably screwed into the upper end of lever (450) until the desired height is obtained.

As shown in FIG. 3, handle (420) is connected to the distal end of lever (450). Handle (420) can have grooves to support the hand. In use, the user depresses handle (420) which in turns depresses the lever (450) which cause bolt member (415) to contact and depress button mechanism (80).

In some embodiments, the length of handle (420) can be adjusted. As shown in FIG. 3, rod (250) is attached to the distal end of lever (450). Handle (420) is adapted to adjustably connect to rod (250) to a desired length. In use, handle (420) is adjusted to accommodate the size of the container (i.e. 20 oz, 2, Liter, or 3 liter or etc.) as well as the size of the user's hand.

Locking mechanism (82) (illustrated in FIGS. 4 and 5) can operate in conjunction with lever (450) and handle (420). Handle (420) can only depress lever (450) while container (200) is in a pouring position, as shown in FIG. 5. Additionally, the entire lever (450) can be removable attached to the pouring spout through hooking mechanism (230). As depicted, hooking mechanism (230) is externally mounted abutting step portion (410) of pouring spout (400).

Figure 6:
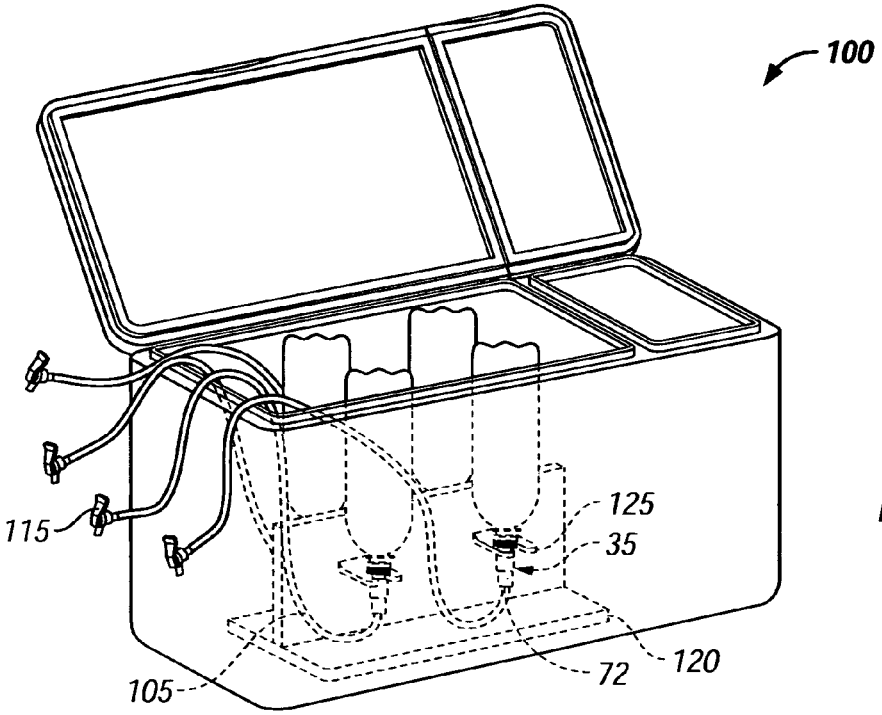
FIG. 6 illustrates an alternative embodiment of the present invention stored in a cooler with each beverage container connected to a separate pouring spout valve.
Figure 7:
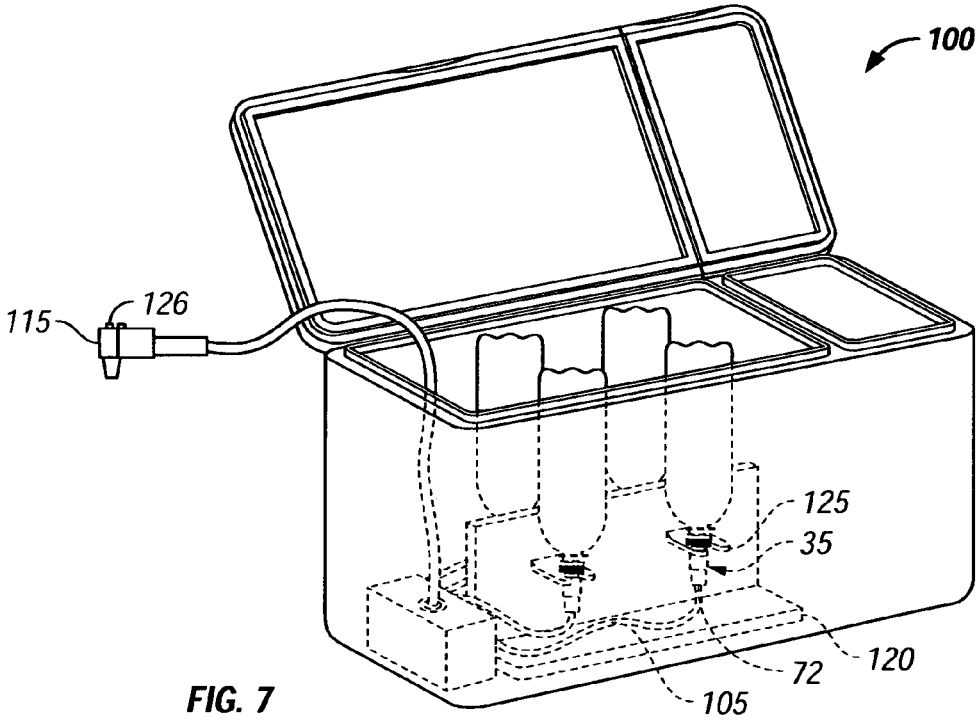
FIG. 7 illustrates an alternative embodiment of the present invention stored in a cooler with each beverage container connected to a separate pouring spout valve.

Referring to FIGS. 6 and 7, there is shown an alternative dispensing mechanism (100). In this alternative embodiment, an elongated pipe (105) interconnects the outlet port (72) of each connector member (35) to a dispensing valve (115). Elongated pipe (105) is operationally connected to dispensing valve (115) in a conventional manner. Dispensing valve (115) provides the capability of controlling the dispensing the beverage from the container.

In this embodiment, dispensing mechanism (100) can support the dispensing of beverage from a plurality of containers with each container containing a different type of carbonated beverage. To support the configuration of dispensing from a plurality of containers, stand (120) is required to securely hold at least one beverage container in an upside down position. In the illustrated embodiment in FIGS. 6 and 7, one type of stand (120) is illustrated. Stand (120) further comprises a bottom panel with a second panel perpendicularly attached near the center of the bottom panel. The second panel extends vertically upward therefrom to a set distance which allows stand (100) to fit into a cooler. Stand (120) further includes a plurality of container holders (125) mounted to the upper end of the second panel. Each container holder has the means for securely holding the upper end of the beverage container in an upside down position.

FIGS. 6 and 7 illustrate two alternative means of dispensing from a plurality of containers. In FIG. 6, each beverage container is connected to a separate dispensing valve (115) (i.e. a conventional pouring spout). However, as shown in FIG. 7, each container can be connected to a single dispensing valve (115). With this configuration, the dispensing valve (115) has a separate means (i.e. a separate button (126)) to control the dispensing of beverage from each connected container.

Additionally, the dispensing mechanism (100) can be adapted to be stored in a cooler, refrigerator or another suitable refrigeration mechanism. As shown in FIGS. 6 and 7, the height of stand (120) is adjusted to allow the stand (120) to fit in a cooler or another type of refrigeration unit.

Figure 8:
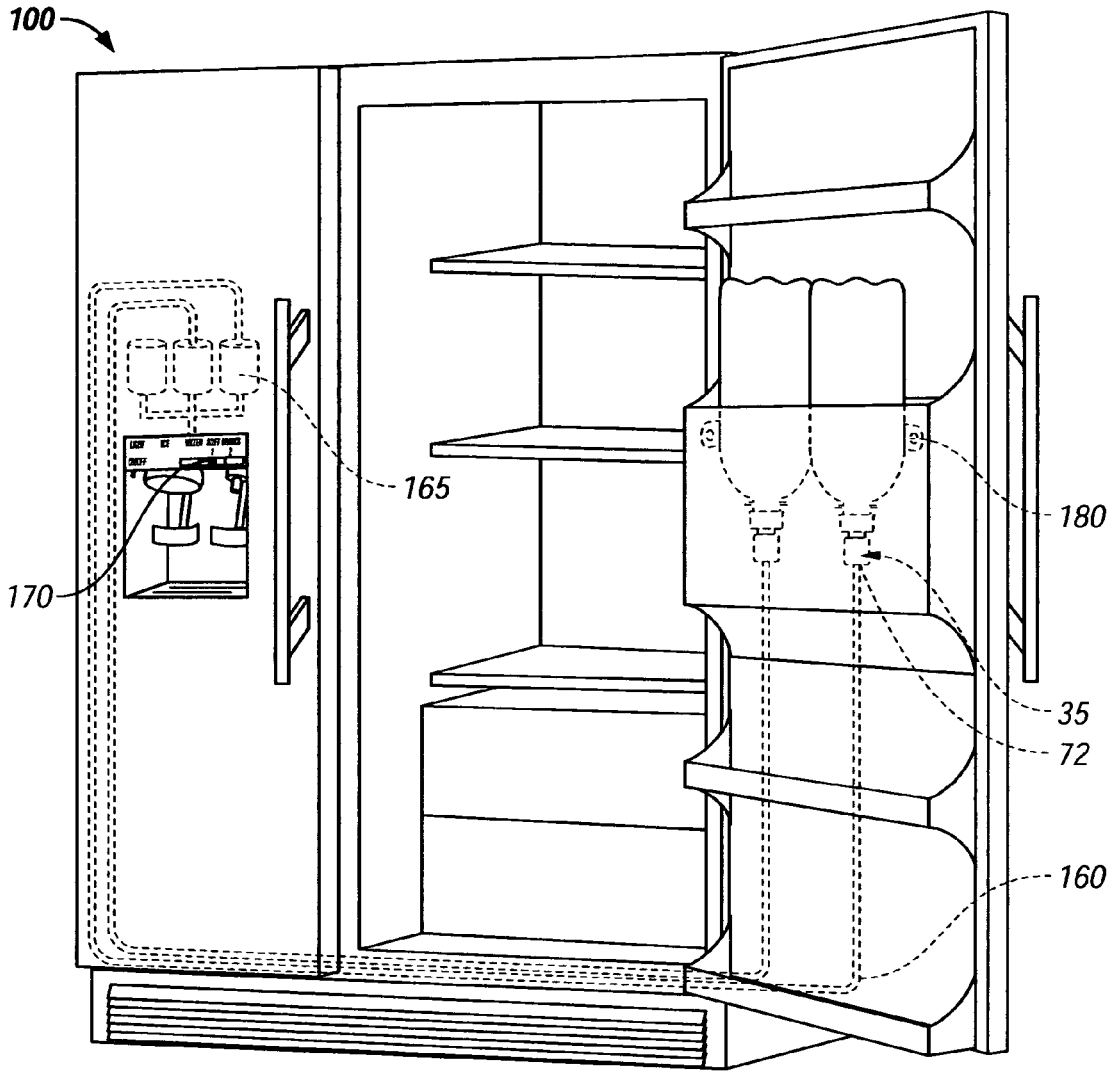
FIG. 8 illustrates an alternative embodiment of the present invention incorporated into a refrigerator.
Figure 9A:
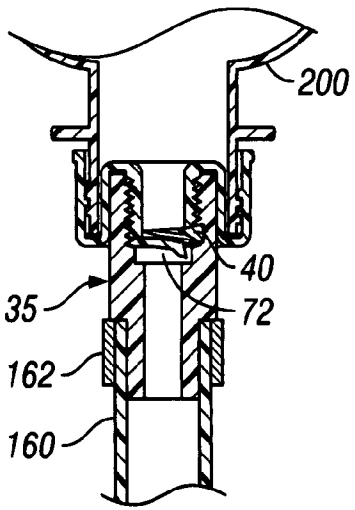
FIG. 9A is an exploded view of the connection between the connector member and the elongated pipe in the refrigerator embodiment.
Figure 9:
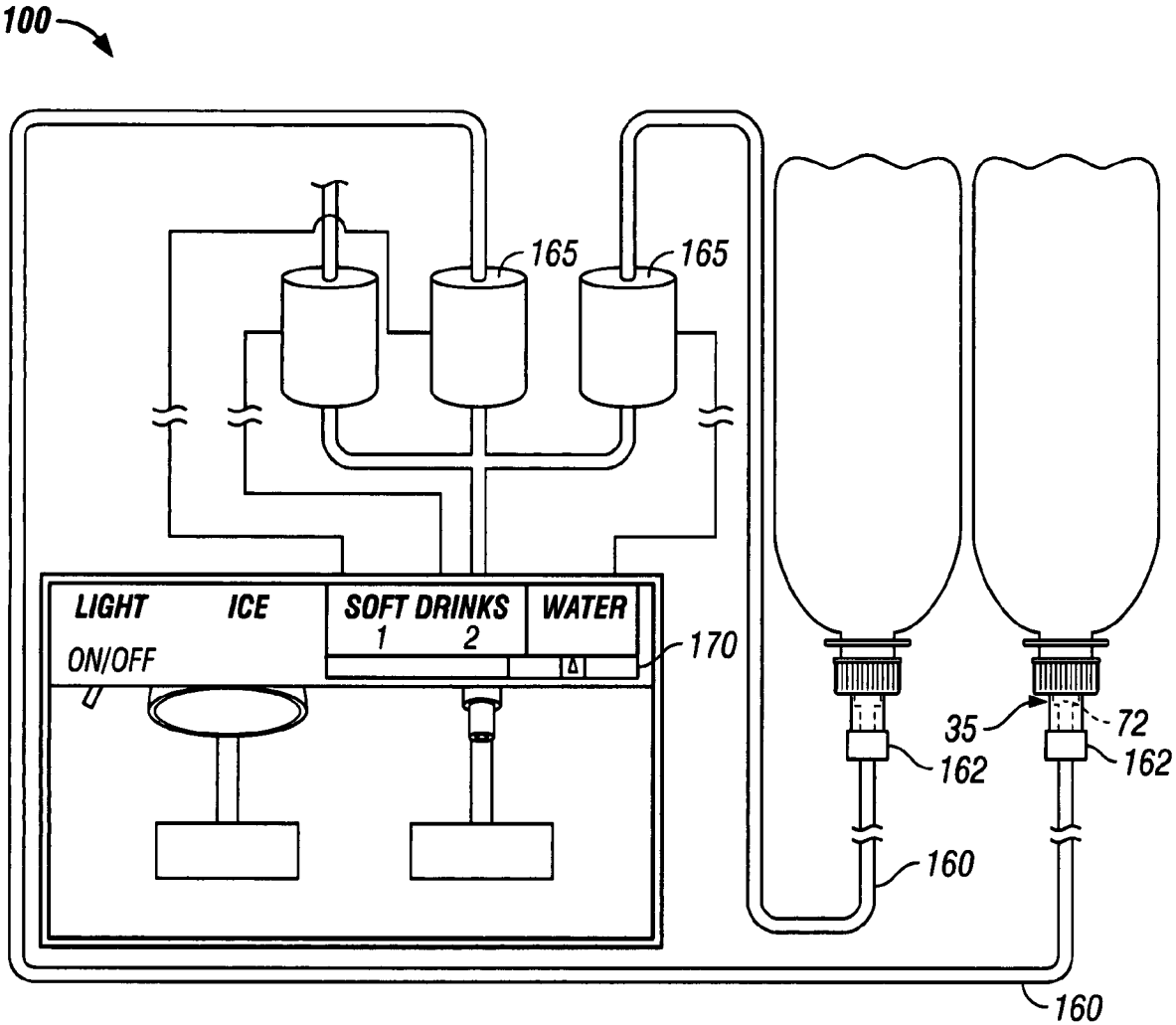
FIG. 9 is an exploded view of the present invention illustrating each beverage container connected to the solenoid valve in the refrigerator.

Referring to FIGS. 8, 9 and 9A, there is shown an alternative dispensing mechanism (100) incorporated into a refrigerator. In this alternative embodiment, an elongated pipe (160) interconnects outlet port (72) of each connector member (35) to a solenoid valve (165). Elongated pipe (160) is operationally connected to solenoid valve (165) in a conventional manner. As shown, the user can then selectively control the initiation and termination of dispensing the beverage through a conventional switch (170).

Referring to FIG. 9A, there is shown an exploded view of the connection between connector member (35) and elongated pipe (160). Pipe member (160) is adapted to be inserted into connecting member (35). Then a fastener (162) (i.e. such as a clamp) is utilized to secure the two together.

As shown in FIG. 8, stand (180) is required to securely hold the containers in an upside down position. As shown the stand (180) can be incorporated within the shelves of the door of a refrigerator. The configuration of the stand (180) utilized in the present invention is not limited to the configuration illustrated in FIG. 8. Additionally, the configuration of the stand (120) utilized in the present invention is not limited to the configuration illustrated in FIGS. 6 and 8.

What is claimed is:

1. A carbonation retaining closure assembly device for beverage containers, the device assembly comprising:

a cap member manufactured to seal and to engage with a mouth of a beverage container;

an inner groove surrounding the outer peripheral edge of the cap member forming a stud within the center of the cap member;

the stud having a threaded outer wall;

a connector member having an internal bore dimensioned to accommodate the length and circumference of the stud; the bore having means for securely engaging upon the outer wall of the stud;

a cutting means internally mounted within the top layer of the bore wherein a slit is punctured within the outer wall as the connector member is engaged upon the stud; and a dispensing mechanism operationally connected to the connector member for dispensing the beverage through the slit such that the carbonation level in the beverage container is retained.

2. The device of claim 1 wherein the dispensing mechanism further comprises:

the connector member defined by an upper end;

an outlet port formed upon the upper end;

a pouring spout being formed upon the outlet port and extending vertically upward to a top end;

an internal bore extending from the outlet port to the top end;

a control valve coupled to the outlet port, the control valve having a movable valve element for opening and closing the outlet port; and a button mechanism coupled to the movable valve element for selectively initiating and terminating the dispensing of the beverage through the outlet port.

3. The device assembly of claim 2 further comprising a locking mechanism coupled to the button mechanism for preventing the operation of the button mechanism while the container is in an upright storage position.

4. The device assembly of claim 2 further comprising:

a lever defined by an upper end and a distal end;

the upper end of the lever being externally connected parallel with the top end of the pouring spout above the button mechanism;

an actuator operationally connected to the upper end of the lever, the actuator adapted to initiate the operation of the button mechanism; and a handle connected to the distal end of the lever, the handle for the depression of the lever wherein the actuator initiates the operation of the button mechanism.

5. The device assembly of claim 4 wherein the actuator further comprises:

a bolt member adjustably connected to the upper end of the lever at a position aligned directly above the button mechanism; and the bolt member projecting perpendicularly outward toward the button mechanism to a predetermined height.

6. The device assembly of claim 3 wherein the handle is adjustable in length.

7. The device assembly of claim 3 wherein the lever is removably connected to the pouring spout.

8. The device assembly of claim 1 wherein the dispensing mechanism further comprises:

a stand adapted to securely hold at least one beverage container in an upside down position, the connector member of the at least one beverage container defined by an upper end;

an outlet port formed upon the upper end of the connector member; and an elongated pipe operationally interconnecting the outlet port to a dispensing valve for selectively initiating and terminating the dispensing of the beverage from the at least one container.

9. The device assembly of claim 8 wherein the dispensing valve is a solenoid valve in a refrigerator.

10. The device assembly of claim 3 wherein the locking mechanism further comprises:

a groove lying along the backside of the button mechanism; and a ball slidably contained within the groove, the ball positioned within the groove to prevent the operation of the button mechanism when the container is in an upright storage position.

11. The device assembly of claim 4 wherein the lever further comprises:

a rod connected to the distal end of the lever; and the handle adapted to adjustably engage upon the rod.

12. The device assembly of claim 1 further comprising a sealing mechanism surrounding the bottom of the stud.

13. The device assembly of claim 6 wherein the handle further comprises grooves to support the handle while in use.

14. A carbonation retaining closure assembly device for beverage containers, the device assembly comprising:

a cap member manufactured to seal and to engage with a mouth of a beverage container;

an inner groove surrounding the outer peripheral edge of the cap member forming a stud within the center of the cap member;

the stud having a threaded outer wall;

a connector member having an internal bore dimensioned to accommodate the length and circumference of the stud; the bore having means for securely engaging upon the outer wall of the stud;

a cutting means internally mounted within the top layer of the bore wherein a slit is punctured within the outer wall as the connector member is engaged upon the stud;

a dispensing mechanism disposed upon the top of the connector member for dispensing the beverage through the slit such that the carbonation level in the beverage container is retained; and the dispensing mechanism further comprising:

the connector member defined by an upper end;

an outlet port formed upon the upper end;

a pouring spout being formed upon the outlet port and extending vertically upward to a top end;

an internal bore extending from the outlet port to the top end of the pouring spout;

a control valve coupled to outlet port, the control valve having a movable valve element for opening and closing the outlet port;

a button mechanism coupled to the movable valve element for selectively initiating and terminating the dispensing of the beverage through the outlet port; and a locking mechanism coupled to the button mechanism for preventing the operation of the button mechanism while the container is in an upright storage position.

15. A carbonation retaining closure assembly device for beverage containers, the device assembly comprising:

a cap member manufactured to seal and adapted to engage with a mouth of a beverage container;

an inner groove surrounding the outer peripheral edge of the cap member forming a stud within the center of the cap member;

the stud having a threaded outer wall;

a connector member having an internal bore dimensioned to accommodate the length and circumference of the stud; the bore having means for securely engaging upon the outer wall of the stud;

a cutting means internally mounted within the top layer of the bore wherein a slit is punctured within the outer wall as the connector member is engaged upon the stud;

a dispensing mechanism disposed upon the top of the connector member for dispensing the beverage through the slit such that the carbonation level in the beverage container is retained; and the dispensing mechanism further comprising:

a stand adapted to securely hold at least one beverage container in an upside down position, the connector member of the at least one beverage container defined by an upper end;

an outlet port formed upon the upper end of the connector member; and an elongated pipe operationally interconnecting the outlet port to a dispensing valve for selectively initiating and terminating the dispensing of the beverage from the at least one container.

16. A carbonation retaining closure assembly device for beverage containers, the device assembly comprising:

a cap member manufactured to seal and to engage with a mouth of a beverage container;

an inner groove surrounding the outer peripheral edge of the cap member forming a stud within the center of the cap member;

the stud having a threaded outer wall;

a connector member having an internal bore dimensioned to accommodate the length and circumference of the stud; the bore having means for securely engaging upon the outer wall of the stud;

a cutting means internally mounted within the top layer of the bore wherein a slit is punctured within the outer wall as the connector member is engaged upon the stud;

a dispensing mechanism disposed upon the top of the connector member for dispensing the beverage through the slit such that the carbonation level in the beverage container is retained; and the dispensing mechanism further comprising:

a stand adapted to securely hold at least one beverage container in an upside down position, the connector member of the at least one beverage container defined by an upper end;

an outlet port formed upon the upper end of the connector member; and an elongated pipe operationally interconnecting the outlet port to a refrigerator solenoid valve for selectively initiating and terminating the dispensing of the beverage from the at least one container.

* * * * *